United States Patent [19]

Jiruse

[11] 4,041,862

[45] Aug. 16, 1977

[54] TRIPPING DEVICE FOR PRINTING CYLINDERS

[75] Inventor: Jaroslav Jiruše, Blansko, Czechoslovakia

[73] Assignee: Adamovske Strojirny, narodni podnik, Adamov, Czechoslovakia

[21] Appl. No.: 674,601

[22] Filed: Apr. 7, 1976

[30] Foreign Application Priority Data

Apr. 10, 1975 Czechoslovakia ..... 2450/75

[51] Int. Cl.[2] ..... B41F 7/06; B41F 13/28

[52] U.S. Cl. ..... 101/218; 101/144

[58] Field of Search ..... 101/137, 140, 142, 144, 101/145, 177, 217, 218, 247

[56] References Cited

U.S. PATENT DOCUMENTS

| | | | |
|---|---|---|---|
| 2,821,911 | 2/1958 | Mestre | 101/144 |
| 3,046,881 | 7/1962 | Jurný | 101/218 |
| 3,490,367 | 1/1970 | Kaneko et al. | 101/144 |
| 3,601,045 | 8/1971 | Schinke | 101/144 |

*Primary Examiner*—J. Reed Fisher

*Attorney, Agent, or Firm*—Burgess, Ryan and Wayne

[57] ABSTRACT

In an offset printing apparatus the tripping into pressure contact as well as the tripping out of pressure contact of the printing cylinders and the operation of the paper feed apparatus are controlled by a multi-arm lever that is operated by a double disk cam. The multi-arm lever operates the various printing cylinders and the paper feed mechanism through a number of control rods.

2 Claims, 5 Drawing Figures

TRIPPING DEVICE FOR PRINTING CYLINDERS

This invention relates to a control device for alternately tripping printing cylinders into pressure contact and out of pressure contact, particularly on offset printing machines. In offset printing machines the pressure contact of the printing cylinders usually is obtained by tripping the offset cylinder into pressure contact with the form cylinder and then to the impression cylinder. The tripping out of pressure contact is carried out by removing the offset cylinder from the named cylinders.

The tripping into pressure contact as well as the tripping out of pressure contact is carried out in certain intervals.

The most simple known devices of this kind are controlled manually. The offset cylinder is tripped into pressure contact with the form cylinder and with the impression cylinder by hand and the cylinders are in this manner prepared for the printing operation.

A disadvantage of such a device is in that the tripping of the printing cylinders into pressure contact is not carried out in synchronism with the printing operation, so that the first paper sheet usually is printed only partially, and a part of the impression cylinder is also printed. For this reason, such devices are, on modern printing machines, functionally connected with the machine and controlled by the machine to achieve the operation of tripping the printing cylinders into pressure contact in the proper cycle of the printing operation.

In this specification, the tripping out of pressure contact of the printing cylinder will be referred to as "tripping-off".

The device according to the present invention essentially consists of a mechanism wherein a multi-arm lever, which is fixed on a pivot, is provided on one hand with a first follower roller and with a second follower roller. The first and second follower rollers are in contact with the functional surface of a double-disk cam. The multi-arm lever is connected by means of a pivot with a control pull rod and by means of a connecting rod with an operating lever which is pivoted on the end of a pivot and which also is connected by means of a pivot with one end of a connecting rod. The second end of the connecting rod is connected by means of a pivot with a control arm which is mounted on the shaft of an offset cylinder. A second control rod for tripping off the printing cylinders is connected by means of a pivot with an arm for the tripping off operation. The arm is swingingly mounted on a tripping-off shaft, on which is fixed a tripping-off lever. The tripping-off lever is connected by means of a first rod for the tripping-off operation with an operation link which coacts with a roller of a feeler element for the control of the trough-passing paper sheet. This feeler element is arranged on the impression cylinder. The operating arm for the tripping-off coacts with one end with a first switching roller of a first microswitch and the second follower roller of the multi-arm lever coacts with a second switch roller of a second microswitch.

The double-disk cam is turnably mounted on a pivot, on which a switching link is also arranged. A carrier pin is fixed on the switching link and coacts with the second end of the operating arm. A pivot is arranged on the switching element. One end of a switching pull rod is attached to the pivot. The other end of the pull rod is connected with a lever of an operating link which is arranged on a shaft of an operating element, whereby the shaft is turnably mounted in a sleeve which is mounted in a side wall of the printing machine. The lever of the operating link is pressed by the effect of a torsion spring on a control link, which is provided with a first and second opening, into which engages one end of a connecting pivot of the control pull rod.

The advantage of the device according to the present invention is that the movement for the tripping into pressure contact operation and for the tripping off of the printing cylinders is derived from one double-disk cam, without any need of spring elements, whereby the cycle of the tripping corresponds to the working cycle of the printing machine.

A further advantage of the device is that the control of the tripping of the printing cylinders into pressure contact can be carried out by turning only the levers for operating the mechanism. The tripping off of the printing cylinders is derived from a feeler element for the control of paper sheets passing through the machine, whereby the operating pull rod may be connected to an electromagnet controlled by electric elements which are arranged on the feeder for the paper sheets.

A further advantage of the device according to the invention is in that the turning of the shaft of the offset cylinder is carried out by fixed elements, which ensure stability of the offset cylinder during the operation for the tripping into pressure contact with the other cylinders, so that the printing pressure value can not vary.

Another advantage of the device is that it enables an automatic disengagement of the operating link from the roller of the feeler element for the control of the paper sheets on the impression cylinder, when the printing cylinders are tripped off from pressure contact.

The device according to the invention also provides the advantage that it can also simultaneously control other mechanisms of the printing machine, as for example the inking device or the damping apparatus. The device also facilitates the electrical control of the feeder device operation, of the sheet counter and the presetting device for the number of paper sheets to be printed.

The device also enables the setting of the printing cylinders in a position apt for the mounting spanning of the printing plate on the surface of the form cylinder.

The invention is illustrated by way of example in the accompanying drawings which form a part of this application and in which.

Figure 1:
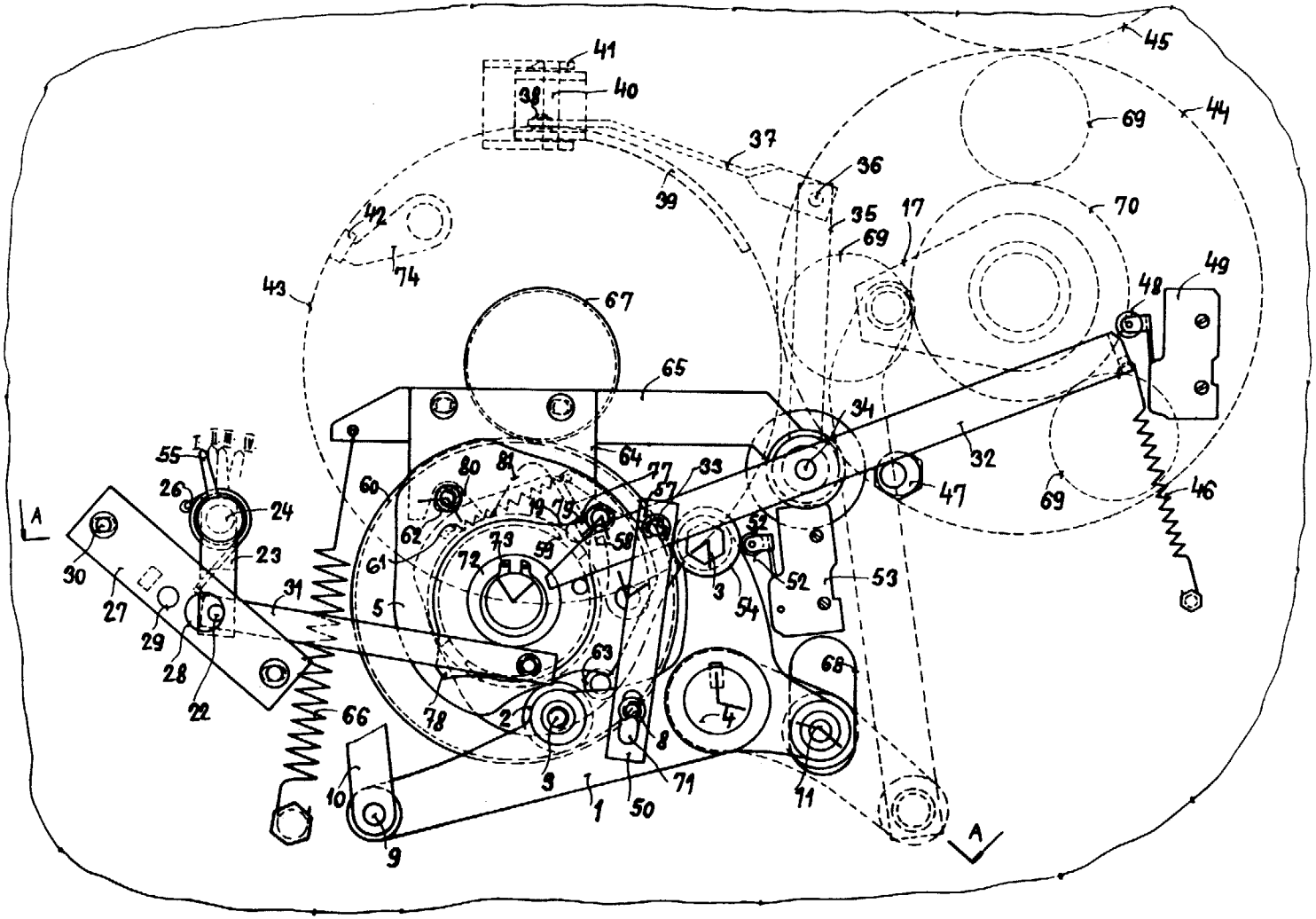
FIG. 1 is a plan view of the device in a position where the printing cylinders are in pressure contact.

The device according to the present invention consists of a multi-arm control lever 1 which is fixed on a pivot 4. The pivot 4 is turnably mounted in a first bearing 13 that is fixed in a side wall 7 of the printing machine. On the multi-arm lever 1, a follower roller 2 and a second follower roller 54 are rotatably mounted by means of pins 3. The first follower roller 2 moves on a guide way of a double-disk cam 5 and the second follower roller 54 moves on a second quideway of said double-disk cam 5 which is turnably mounted on a pivot 6. The pivot 6 is fixed in the side wall 7 of the printing machine. On the multi-arm lever 1, a second operating pull rod 50 provided with a recess 71 is attached by means of a pivot. A control pull rod 10 for the control of the inking device is also attached to the multi-arm lever with a pivot. One end of a connecting pull rod 11 is also attached to the multi-arm lever. Rod 11 passes through an opening 68 in the side wall 7 of the printing machine and is connected with a control lever 12 that is pivotally mounted on the end of the pivot 4, on the inner side wall 7. One end of connecting rod 14 is attached to one end of the control lever 12 by means of a pivot 15. Rod 14 is provided on its other end with a pivot 16. On this pivot 16 is pivotally mounted a control arm 17 that is rigidly connected with a shaft 18 on which is mounted an offset cylinder 44. On both ends of the shaft 18 of the offset cylinder 44 are arranged cams 70 mounted between supporting rolls 69 that are attached on the side wall 7 of the printing machine. On the cam pivot 6 is turnably mounted an operating link 19, on which is fixed a carrier pin 20 and a pivot 21 for a pull rod. The operating link 19 is provided on one side of its functional circumference with a first projection 78 and on the other side of its functional circumference with a second projection 79, whereby the operating link 19 is axially secured on the pivot 6, by means of a supporting ring 72 and with a securing element 73. One end of a control rod 31 is attached to pivot 21. The other end of the control rod is connected by means of a connecting pin 22 with an operating lever 23. The operating lever 23 is fixed on a shaft 24 that is rotatably mounted in a bush 25 fixed in the side wall 7 of the machine. On the side wall 7 are also mounted holders 30. On each holder is adjustably arranged an operating link 27. In the operating link 27, there is provided a first opening 28 and a second opening 29, in which a connecting pin 22 is engaged. A torsion spring 26 has one end attached to the side wall 7 of the printing machine and bears with its second end on the operating lever 23. On a shaft 24 of the operating mechanism, there is fixed a control lever 55. An arm 32 for the tripping-off operation is rigidly attached on a shaft 34 for the tripping-off operation. A lever 35 is also connected to the shaft. The lever 35 is connected by means of a pivot 36 with a first pull rod 37 for the tripping-off operation. The first pull rod 37 is by means of a pivot 38 pivotally connected with an operating link 39 for the tripping-off operation. Operating link 39 is swingingly arranged on a shaft 40 mounted in a holder 41 fixed on the side wall 7 of the printing machine. On an impression cylinder 43 are attached feeler elements 74 serving for the control of the through passing paper sheets. On these feeler elements are mounted rollers 42 for the tripping-off operation. On the impression cylinder 43, there is also mounted a drive gear 67 which is in engagement with a gear 60, on the hub of which are provided carrier slots 59. On the side face of one of the disks of the double-disk cam 5, there is adjustably fixed a first roller 62 and on the side face of the second disk of the double-disk cam 5, there is fixed a second roller 63. On the side face of the double-disk cam 5 is fixed a pivot 56, on which is pivotally mounted a pawl 57. The pawl 57 is provided with a projection 58 which engages into carrier slots 59 of the carrier gear 60. On the pawl 57, there is fixed a carrier pivot 75 which passes through a slot 77 which is formed in both the disks of the double-disk cam 5, whereby on the end portion of the carrier pivot 75, there is mounted a roller 76 for the pawl. On the end of the pawl 57 is attached one end of a second pull spring 61. The other end of the pull spring 61 is hinged to the side face of the double disk cam 5. The arm 32 for the tripping-off operation bears with one end on a first microswitch 49 arranged on the side wall 7 of the machine. On said end of the arm 32, there is attached one end of a first pull spring 46 which is hinged with its other end on the side wall 7 of the machine. On the second end of the arm 32 for the tripping-off operation is mounted by means of a pivot 33 a second pull rod 50 for the tripping off operation. The arm 32 bears on an eccentric stop element 47 which is fixed on the side wall 7 of the printing machine. The shaft 34 for the tripping-off operation is turnably mounted in a second bearing 51 which is fixed in the side wall 7 of the machine. On the outer cylindrical part of the second bearing 51, there is swingingly arranged a securing link 64. One end of securing link 64 is hinged to a securing spring 66, the other end of which is attached to the side wall 7 of the machine. The securing link 64 is provided with a first recess 80 and a second recess 81. On the side wall 7 of the machine, there is further fixed a second microswitch 53 which is provided with a second operating roller 52. A second guide roller 54 of the multi-arm lever 1 bears on the surface of the second operating roller 52.

The described machine operates as follows:

Before the start of the printing operation the impression cylinder 43, the offset cylinder 44 and the form cylinder 45 (see FIG. 2) are out of pressure contact and their surfaces are a certain distance from each other. To start the printing operation of the machine it is necessary to shift the starting lever 55 from position II to the position III. In response to this the operating link 19 is turned by means of the lever 23 and the pull rod 31 for the tripping operation is moved in such a way that the roller 76 of the pawl moves down from the first projection 78. In response to this the pawl 57 seats due to the effect of the second pull spring 61 on the hub of the continually rotating gear 60 and the tooth 58 of the pawl 57 engages into the slot 59 so that the double-disk cam 5 also begins to rotate. In response to this the second roller 63 overcomes the pulling force of the securing spring 66 and lifts the securing link 64. By the rotation of the double-disk cam 5, the multi-arm lever 1 is swivelled by means of the first guide roller 2 and the second follower roller 54 in such a way that the inking device and the damping apparatus is brought by means of control pull rod 10 into functional position. Simultaneously the arm 32 for the tripping-off operation is released. In the following operation the arm 32 is swivelled in such a way as to come to seat, also by the effect of the first pull spring 46, on the eccentric stop element 47.

In this way, by means of the shaft 34 for the tripping-off operation, the lever 35 and the first pull rod 37 for the tripping-off operation bring the operating link 39 into the operating position in such a way, that it becomes placed with its recesses in the functional way of the follower roller 42. Simultaneously the offset shaft 18 with the cam disks 70 are also rotated by means of the connecting rod 14 and the control arm 17. The effect of the torsion spring 26 brings the lever 55 into position I for starting, whereby the connecting pin 22 seats on the rim of the first opening 28 which is provided in the operating link 27. In response to this the operating link 19 is turned to a steady position, while the roller 76 of the pawl rides on the procession 79 of the operating link 19. Due to that the tooth 58 comes out of engagement from the guiding slot 59, whereby the double-disk cam 5 comes to a stop in such a position, that the first guide roller 62 enters into the first recess 80 of the securing link 64. By turning the arm 32 the first switching roller 48 of the first microswitch 49 is brought into starting position. The second follower roller 54 of the multi-arm lever 1 changes the position of the second switching roller 52, so that the second microswitch 53 provides an electric pulse to start the function of the counter device for counting the printed paper sheets. The whole tripping operation to bring the printing cylinders into pressure contact is carried out in phases in such a way that first the damping apparatus and the inking device are brought to operation. Then the offset cylinder 44 is brought into pressure contact with the form cylinder 45 and finally with the impression cylinder 43 in the phase, where the whole printing plate already is covered with ink for printing. The first paper sheet is printed with the printing image over the whole surface of the sheet.

During the printing operation the impression cylinder 43, the offset cylinder 44 and the form cylinder 45 are in full pressure contact and the whole device is set in a position as illustrated in FIG. 1. When the printing work is finished or when a failure on the machine occurs, for example in the feeding of sheets, where no paper sheets are carried to the impression cylinder 43 to be printed, the feeler element 74 for the control of the presence of a sheet disengages the switch-off operating roller 42. The operating roller 42 turns the switch off operating link 39. By means of the lever 35 and shaft 34 the switch-off operating link 39 turns the arm 32. Arm 32 further turns by means of carrier pin 30, the operating link 19 in such a way that the roller 76 of the pawl moves down from the second projection 79 of the operating link 19. The pawl 57 seats due to the effect of the second pull spring 61 on the hub of the gear 60, whereby the tooth 58 of the pawl 57 engages into the guide slot 59 and the double-disk cam 5 begins to turn. The first follower roller 62 lifts the securing link 64 and is then shifted out of engagement with the recess 80. By the turning of the double-disk cam 5 the multi-arm lever 1 is set by the first follower roller 2 and the second follower roller 54 in the position to put out of operation the inking device and the damping apparatus of the printing machine.

Simultaneously the impression cylinder 43, the offset cylinder 44 and the form cylinder 45 are tripped off, whereby the first pivot 8 of the pull rod is shifted to the end position of the recess 71. By this and by means of the second pull rod 50 for the tripping-off operation the arm 32 for the tripping-off operation which is fixed on the shaft 34 is set. By means of the shaft 34 for the tripping-off operation the operating lever 35 which is connected by means of the pivot 36 with the pull rod 37 for the tripping-off operation is shifted, bringing the operating link 39 with the first pull rod 37 for the tripping-off operation from the functional position in such a way that while the printing machine is idle the operating link 39 is out of the functional way of the operating roller 42. The second follower roller 54 is freed, thereby releasing the second operating roller 52, whereby the microswitch switches off the counter device for the printed sheets.

When the double-disk cam 5 is turned, the roller 76 of the pawl rides on the first projection 78 of the operating link 19, and in response to this the tooth 58 is shifted out of the guide slot 59, whereby the double-disk cam 5 stops and the second roller 63 enters into the first recess 80 of the securing link 64.

By the shifting of the control arm 32, the first roller 48 of the first microswitch changes its position, which gives a pulse for the stopping of the sheet feeder mechanism.

Figure 2:
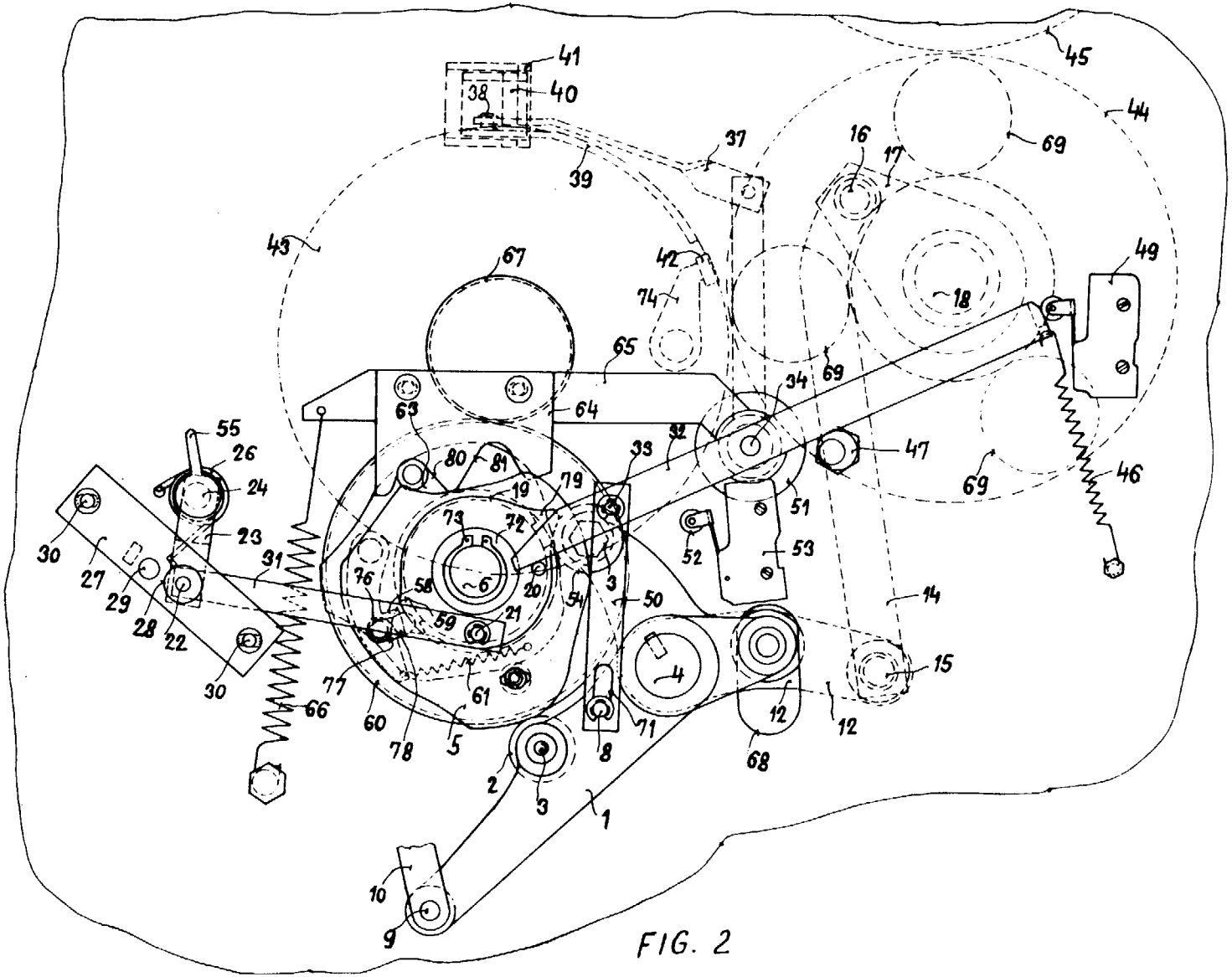
FIG. 2 shows a plan view of the device in a position where the printing cylinders are tripped off printing pressure contact.

The operation of tripping-off the printing cylinders from pressure contact is carried out in such a way and sequence, that the last paper sheet passing through the machine still is printed on the whole surface. The mechanism for tripping-off the printing cylinders into pressure contact is set in a position as shown in FIG. 2. Before mounting the printing plate on the form cylinder 45, the device has to be adjusted in the required mounting position in such a way, that the lever 55 is shifted in the direction to the side wall 7 of the machine against the pressure of the torsion spring 26. In response to this the connecting pivot 22 is brought out from the opening 28, further by swivelling the lever 55 to a position IV and by releasing said lever, the connecting pin 22 enters into the second opening 29 of the operating link 27. Simultaneously also the operating link 19 is turned and the mechanism of the device carries out the same operation as when being set for tripping the printing cylinders into pressure contact, but with the difference that the turning of the operating link 19 results in the partial turning of the double-disk cam 5 and then is secured by the engagement of the first roller 62 into the second securing recess 81 of the operating link 64. The cams 70 also partially are turned so that the off-set cylinder 44 comes into contact with the form cylinder 45, whereby a gap remains between the offset cylinder 44 and the impression cylinder 43. With regard to that, the carrier pin 20 is placed in a considerable distance from the operating arm 32, the tripping off of the printing cylinders from the pressure contact is not carried out and the operating link 39 gives the normal impluse.

Figure 3:
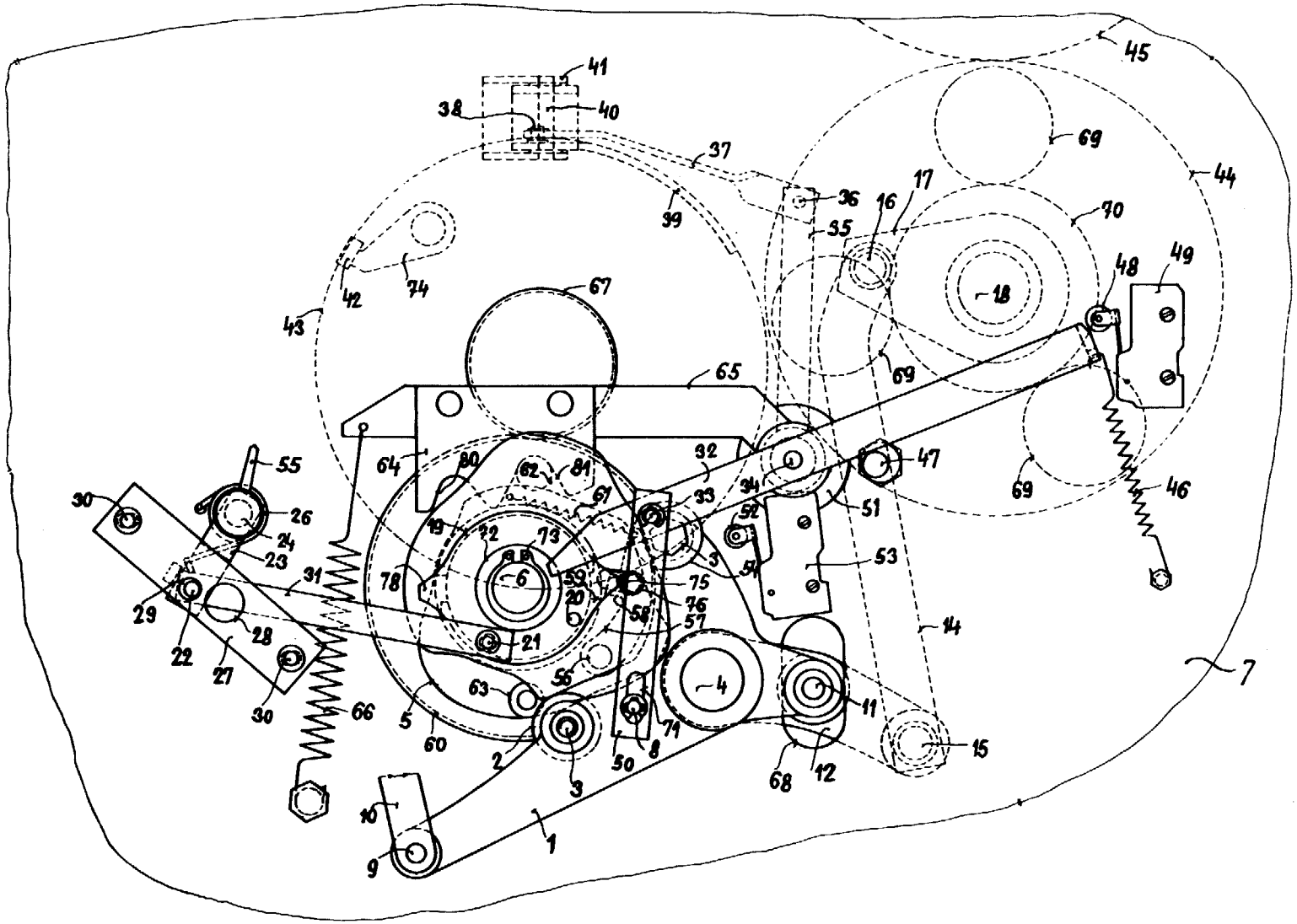
FIG. 3 is an illustration of a partial view of the device in a position apt for the mounting of the printing plate, where the offset cylinder is in contact with the form cylinder, but between the offset cylinder and the impression cylinder remains a gap.
Figure 4:
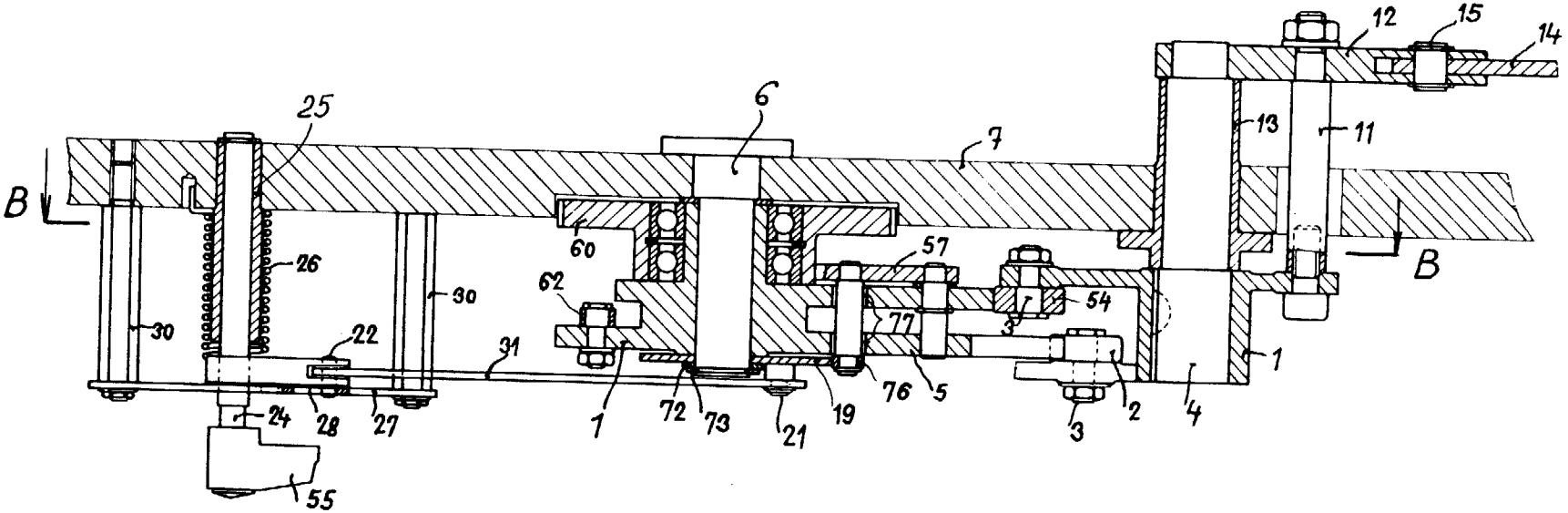
FIG. 4 is a sectional view along the plane A—A of FIG. 1.
Figure 5:
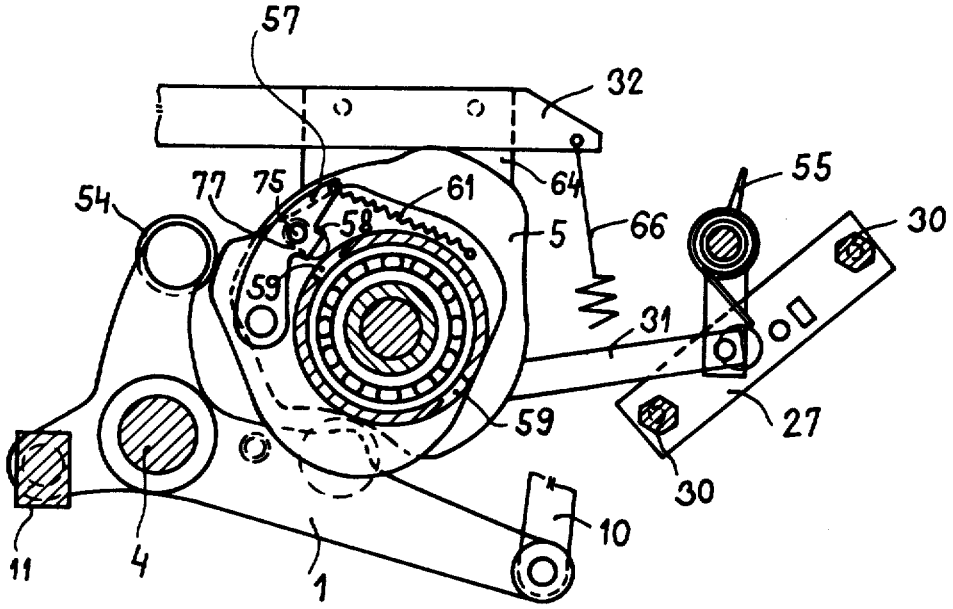
FIG. 5 shows a partial section in the plane B—B of FIG. 4.

The device for tripping the printing cylinders is set in a position as illustrated in FIG. 3.

The setting of the device from this position is carried out after the mounting of the printing plate which is carried out by shifting the lever 55 by hand in the direction of the side wall 7 of the printing machine. The torsion spring 26 turns the lever 55 to position I and by this operating lever 23 and the operating link 19 are also adjusted.

Said device carries out the tripping of the printing cylinders into pressure contact and when no paper sheet is carried to the impression cylinder, the printing cylinders are tripped out of printing contact without transferring a first printed image to a paper sheet. The device stops in a position as shown in FIG. 2 and the lever 55 is mechanically brought into initial position II.

What I claim is:

1. A device for tripping printing cylinders into printing pressure contact, particularly on offset printing machines, comprising a multi-arm lever fixed on a first pivot and having a first follower roller and a second follower roller, said rollers being in riding contact with a double disk cam, said lever being connected by means of a second pivot to a second pull rod, by means of a third pivot to a control pull rod, and by means of a first connecting rod to an operating lever, said operating lever being pivotally mounted on the end of the first pivot and being further connected by means of a fourth pivot to one end of a second connecting rod, the other end of the second connecting rod being pivotally connected to a first control arm mounted on a first shaft of an offset cylinder, and further comprising a second operating pull rod connected by means of a fifth pivot to a second control arm pivotally mounted on a second shaft, a control lever on said second shaft and connected by means of a first operating pull rod for tripping off operation with an operating link for tripping off operation which cooperates with a roller of a feeler element for the control of paper sheets, said feeler being mounted on an impression cylinder, whereby the second control arm coacts with one end with a first operating roller of a first microswitch and the second follower roller coacts with a second operating roller of a second micro-switch.

2. A device according to claim 1, characterized in that the double disk cam is rotatably mounted on a sixth pivot, an operating link mounted on said sixth pivot, a carrier pin on the operating link and coacting with the second end of the second control arm, a seventh pivot on the operating link, one end of a control pull rod being on the seventh pivot, the other end of the control pull rod being connected by means of a connecting pin to a control lever turnably arranged in a bush fixed in a side wall of the printing machine, whereby the control lever is pressed by the effect of a torsion spring on an operating link having a first opening and a second opening, said openings selectively engaging one end of said connecting pin of the control pull rod.

* * * * *